US005090930A

United States Patent [19]

Walden

[11] Patent Number: 5,090,930

[45] Date of Patent: Feb. 25, 1992

[54] POWER-DRIVEN FLOAT ASSEMBLY

[76] Inventor: Robert R. Walden, 8995 W. 32nd Ave., Wheat Ridge, Colo. 80033

[21] Appl. No.: 733,096

[22] Filed: Jul. 19, 1991

Related U.S. Application Data

[63] Continuation-in-part of Ser. No. 606,479, Oct. 31, 1990, abandoned.

[51] Int. Cl.[5] ..... B63B 3/00

[52] U.S. Cl. ..... 441/131; 114/345; 114/346; 441/6

[58] Field of Search ..... 441/65, 66, 67, 45, 441/130, 131; 114/345, 346; 440/6, 7

[56] References Cited

U.S. PATENT DOCUMENTS

| | | | |
|---|---|---|---|
| 2,529,961 | 11/1950 | Phillips | 441/131 |
| 2,674,753 | 4/1954 | Wood | 441/130 |
| 3,324,488 | 6/1967 | Schulz | 441/131 |
| 3,718,111 | 2/1973 | Del Vecchio | 114/346 |
| 4,911,094 | 3/1990 | Akers | 114/346 |
| 4,938,722 | 7/1990 | Bizley | 441/131 |

*Primary Examiner*—Jesus D. Sotelo
*Assistant Examiner*—Stephen P. Avila
*Attorney, Agent, or Firm*—Fields, Lewis, Pittenger & Rost

[57] ABSTRACT

A power-driven float device includes a combination and inflatable float tube, a support body for the power supply on which there is mounted a vertical shaft and an electric motor and impeller together with the battery for powering the electric motor and means for releasably attaching the support body to the float tube. The float tube, support body and vertical shaft are easily assembled and disassembled. The float tube is shown to the front or either side of the support body. Band-type and strap-type harness assemblies firmly embrace the float tube to releasably secure the float tube to the support body. A storage body of a size and shape and construction in one embodiment is mounted opposite the support body.

23 Claims, 6 Drawing Sheets

POWER-DRIVEN FLOAT ASSEMBLY

This application is a continuation-in-part of application Ser. No. 606,479 filed Oct. 31, 1990, now abandoned.

TECHNICAL FIELD

This invention relates to inflatable float tubes used for traversing bodies of water for hunting, fishing and the like and more particularly to a novel and improved power-driven float device.

BACKGROUND ART

There are currently in use a number of different types of air inflated float tubes used to provide flotation for outdoorsmen for fishing, hunting and the like. These float tubes are currently propelled by the legs and feet of the user.

There are a number of float devices shown in the prior art. Phillips U.S. Pat. No. 2,529,961 discloses a harness that attaches to a float device that extends around the shoulders of an occupant.

Wood U.S. Pat. No. 2,674,753 discloses a float device having fore and aft sections attached thereto by rigid stringers made of hollow metal.

Schulz, Jr. U.S. Pat. No. 3,324,488 discloses a rigid plastic float device that is filled with a low density expanded polyurethane material. The motor supporting platform is formed integral with the float device.

Akers U.S. Pat. No. 4,911,094 discloses a second separate float tube joined to the occupant tube by straps. The motor is disclosed as being in a locked position.

The present invention includes a support body that is readily attached to and detached from a float tube which enables the float tube to be power-driven thereby enhancing the operation of the float tube.

DISCLOSURE OF INVENTION

A power-driven float device includes a combination and inflatable float tube, a floatable support body for the power supply on which there is mounted a vertical shaft and an electric motor and impeller together with the battery for powering the electric motor and means for releasably attaching the support body to the float tube. The float tube, support body and vertical shaft are easily assembled and disassembled. In one form disclosed the support body for the power assembly is to the rear of the float tube and in another form disclosed the support body is to either the left or right side of the float tube or at a selected intermediate position. In one form flexible bands extend around the float tube and are tied by a tie string. In another form upper, lower, and vertical straps form a fastening harness. A floatable storage body of a size and shape corresponding with that of the support body for the power supply is held by an auxiliary harness section in a position against the float device opposite the support body.

BRIEF DESCRIPTION OF THE DRAWINGS

Details of this invention are described in connection with the accompanying drawings which like parts bear similar reference numerals in which.

DETAILED DESCRIPTION

Figure 1:
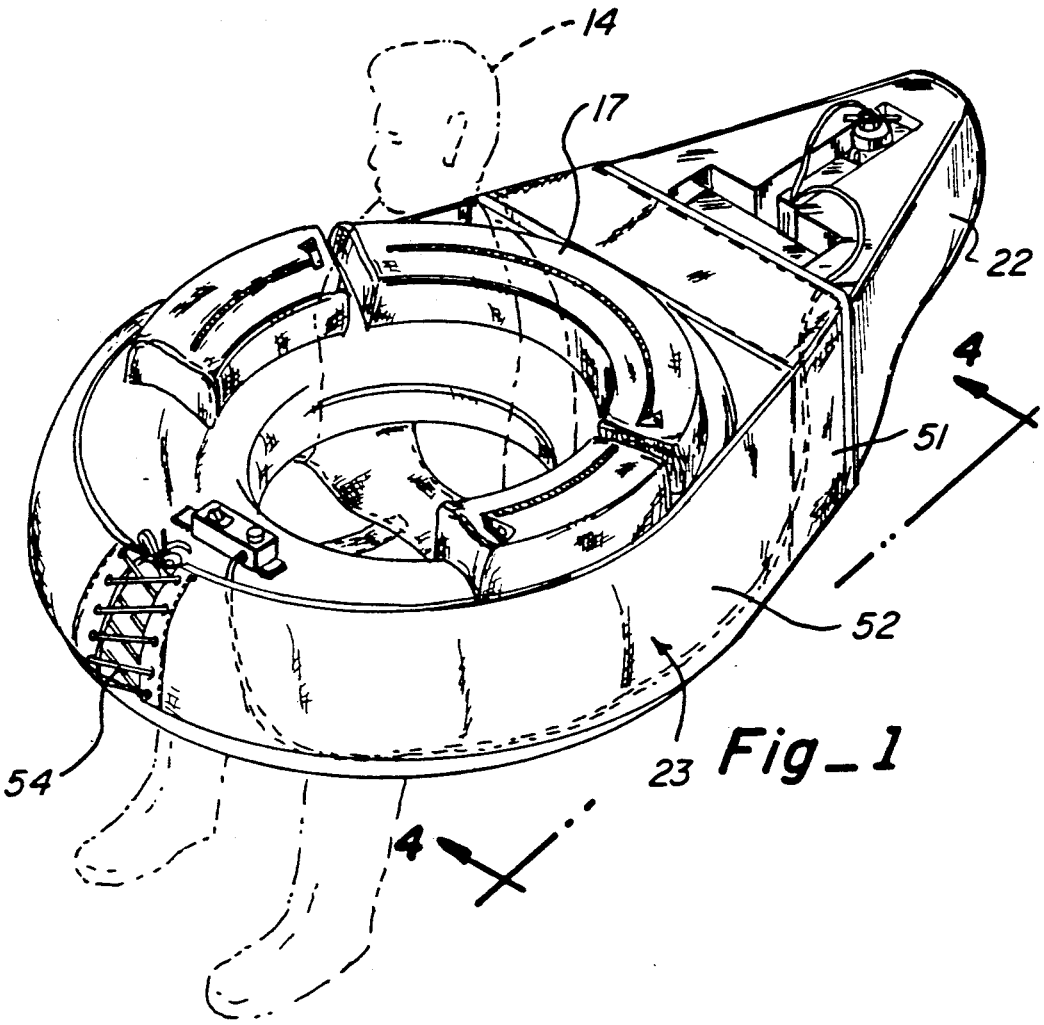
FIG. 1 is a perspective view of a power-driven float assembly embodying features of the present invention.
Figure 3:
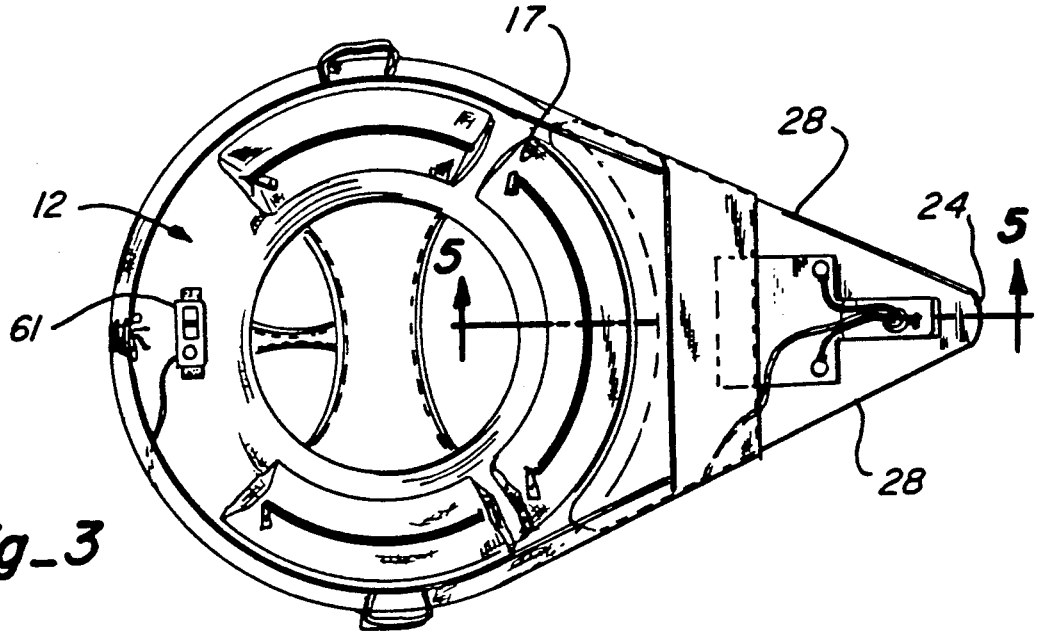
FIG. 3 is a top plan view of the assembly shown in FIG. 1.
Figure 2:
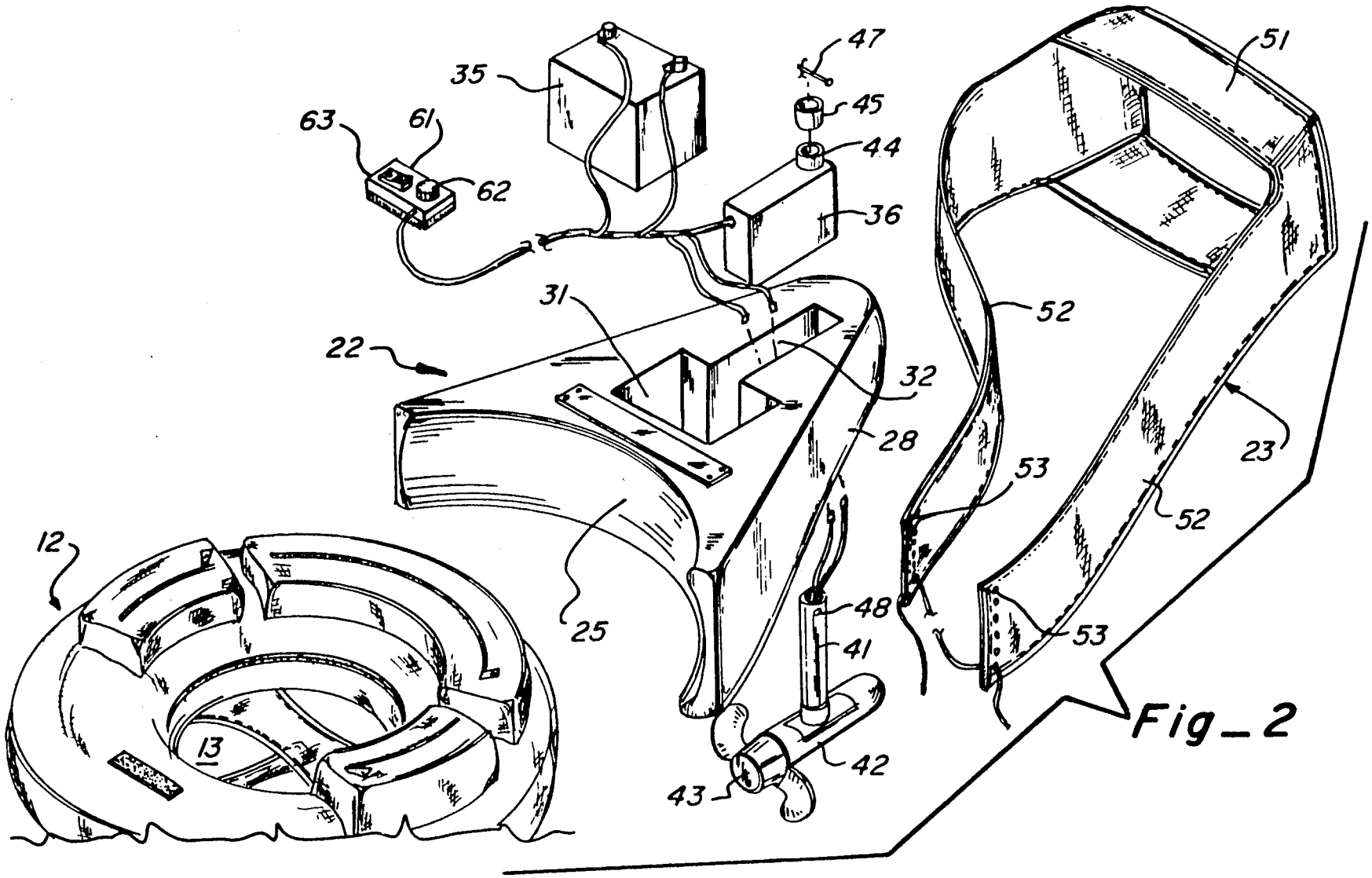
FIG. 2 is an exploded view of the assembly shown in FIG. 1.
Figure 4:
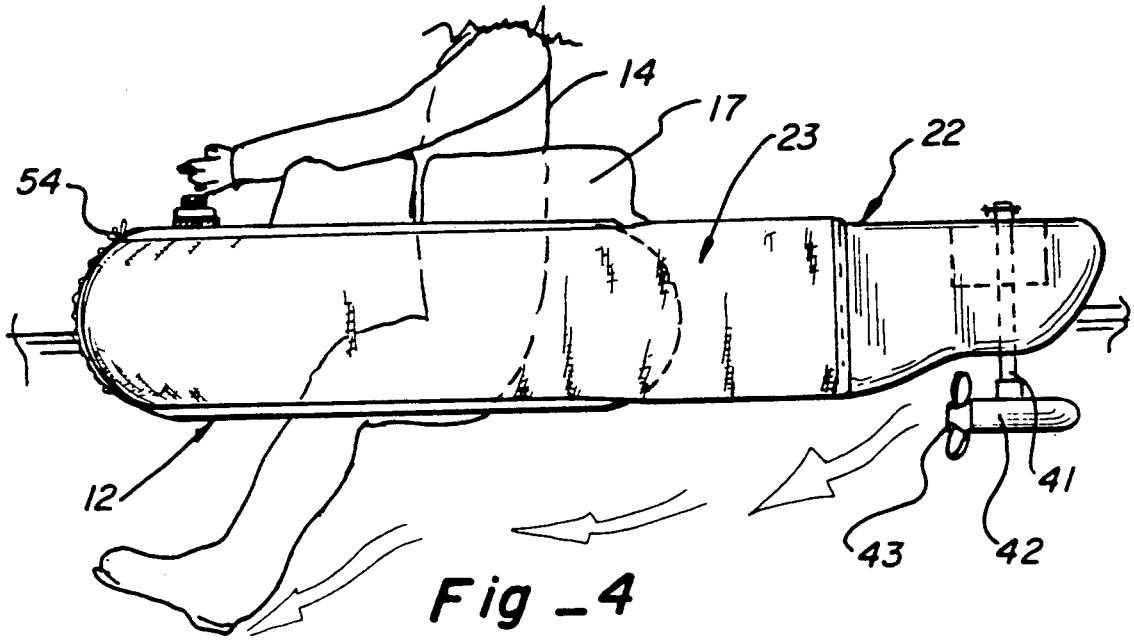
FIG. 4 is a side elevational view taken along line 4—4 of FIG. 1.
Figure 5:
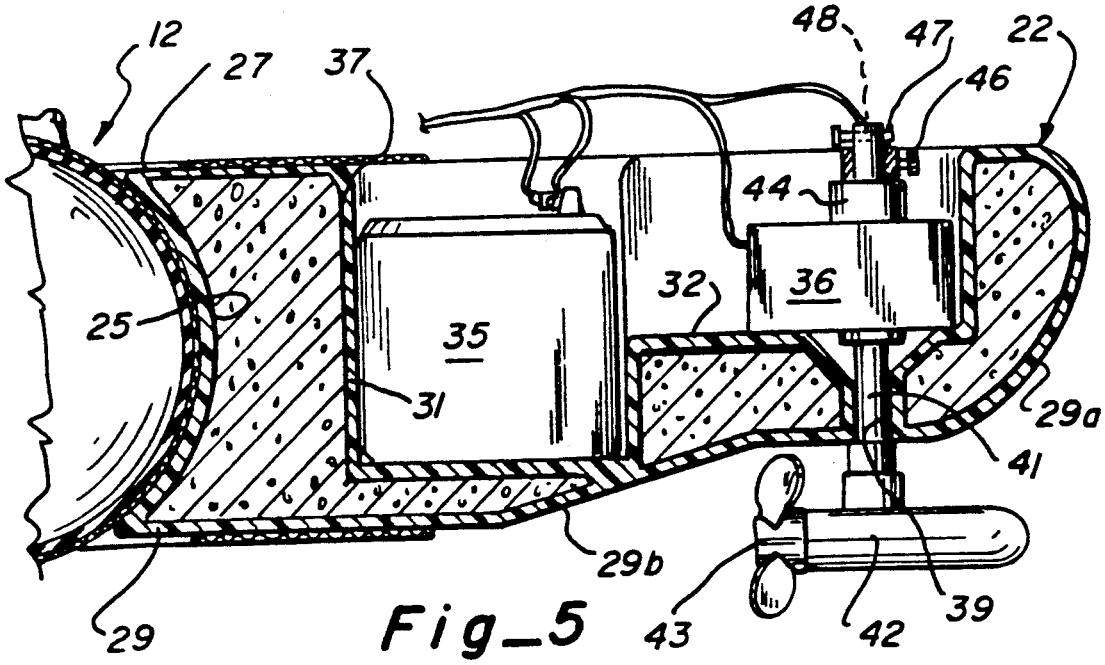
FIG. 5 is a sectional view taken along line 5—5 of FIG. 3.

Referring now to the drawings there is shown a conventional air-inflatable float device 12 that is generally of a donut or torus shape and is air-inflatable having a central opening or central open area 13 for accommodating the user or occupant 14 indicated in dashed lines. The device 12 has a bottom strap or seat web 15 on which the user is seated with the legs extending through leg holes 16 on one side of the strap 15. A wrap-around back rest 17 is shown. The device 12 is typically made of a nylon, is waterproof and is air tight. The float device 12 is inflated by the user with a pump or compressor and is readily deflated for transport.

A floatable support body 22 is shown releasably attached to the flotation device 12 by a fastening harness 23. In general, the support body 22 is rearwardly tapered from front to rear or from the inner end to the outer end along the sides with a rounded rear end portion 24 and further has a forward arcuate recessed portion 25 at the front sized and shaped to conform to the rounded exterior of device 12. The forward end portion 25 is of less width than the external diameter of the float device. In particular, the support body 22 has a flat top wall 27, a pair of rearwardly converging side walls 28 and a bottom wall 29. The bottom wall has a downwardly and forwardly curved portion **29*a* at end portion 24 and an intermediate tapered section 29*b*** to direct the flow of water away from the occupant's legs.

The support body 22 shown has recessed wall portions 31 sized and shaped to receive and support an electric battery 35 and also has recessed wall portions 32 sized and shaped to receive and support a shaft mounting and rotation box 36. A vertical hole 38 is found in the bottom wall 29 below wall portion 29.

The support body 22 shown is constructed as having a rigid outer layer or skin 37 that is filled with inner fill material 38. The outer skin is preferably polyethylene and the inner layer is a foam which is a polyurethane fill material. A preferred molding process preferably used for making support body 22 shown is known as rotational molding. A support body so constructed will support the user in water independently of the float device in case it becomes deflated.

A power assembly carried by the support body includes a vertical shaft 41 and an electric motor 42 rotatably supporting an impeller 43 at the lower end of the shaft 41. The shaft 41 is vertically mounted in the hole 39 in the support body and extends up through a sleeve 44 in the box 36. The sleeve 44 mounts the shaft for rotation about a vertical axis and upon rotation turns the motor and impeller from side to side. A collar 45 interfits with the top of the sleeve. A set screw 46 locks the collar and sleeve to the shaft 41. A pin 47 extends through a hole 48 in the top of the shaft to secure the shaft in the support body. The pin is a back-up fastener in case the set screw is inadvertently released. The shaft mounting and rotation box 36, shaft 41, motor 42 and impeller 43 are available as a unit from MINN KOTA Model 35. The shaft 41 has been shortened for the preferred embodiment.

The fastening harness 23 preferably made of a durable fabric shown includes a front closed band 51 portion that slide fits over the rear or outer end of the support body 22 and is moved in a direction from rear to front until it draws tightly against the support body and a pair of side bands or straps 52 which terminate in front end portions each having a series of spaced holes 53. The height of the bands is slightly less than the height of the float device and the same height as the support body. A cord or tie line 54 is passed through these holes to lace the ends of the straps to the inflation device and thereby securely fasten the support body to the float device. It is understood that other fastening arrangements could be provided.

A control member 61 is placed on the front of the device 12 is shown releasably held there by velcro fasteners or the like. The control member has a speed control knob 62 that is rotated to adjust the motor speed and a double throw switch 63 that changes direction to go left or right.

The apparatus above described is easily assembled by attaching the harness 23 to the support body 22, tying the line 54 and inflating the device 12. The shaft 41 is inserted into the sleeve 44 of box 36 and pin 47 is inserted into hole 48. The set screw 46 is tightened. The apparatus is disassembled by a reverse procedure so that the three major parts are easily stored in the back of the vehicle.

Referring now to FIGS. 6–11 there is shown another embodiment of a power-driven float assembly which includes the inflatable float device 12 with an inner cavity 13 traversed by a bottom web or strap 15 on which the user is seated with the legs extending through a hole 16 on one side of strap 15 as previously described. A floatable support body 72 is shown as releasably attached to the float device 12 by a fastening harness 73.

Figure 6:
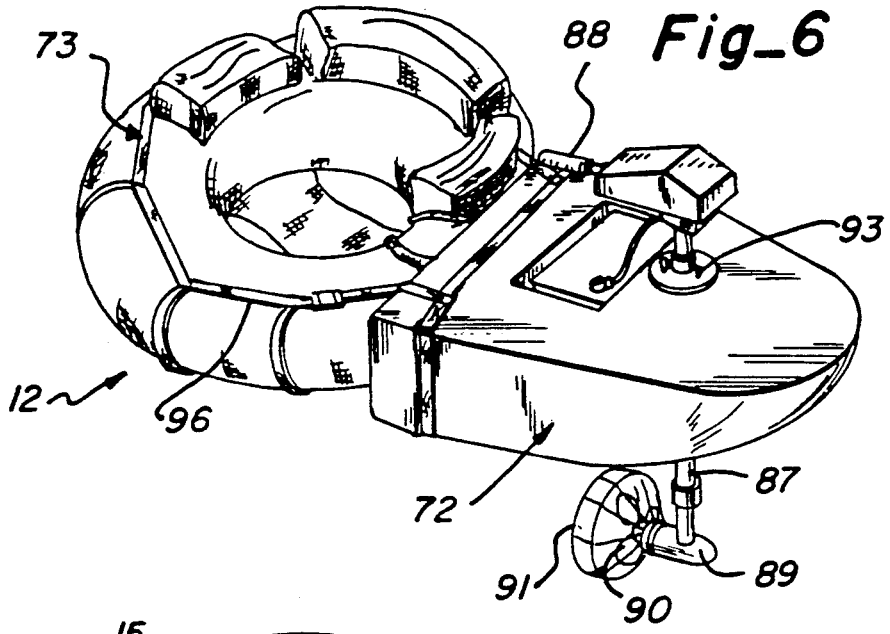
FIG. 6 is a perspective view of another form of a power-driven float assembly embodying features of the present invention.
Figure 7:
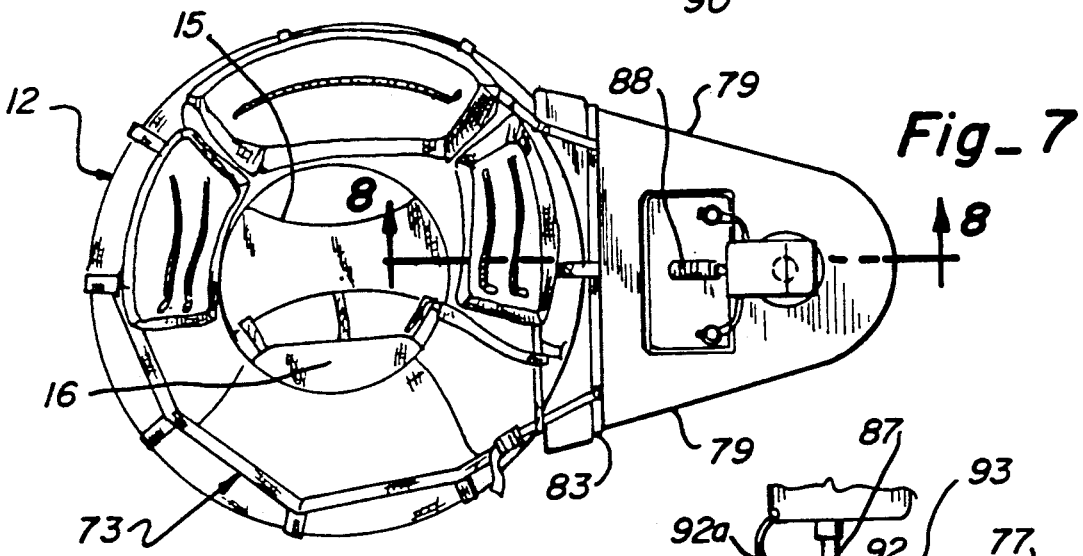
FIG. 7 is a top plan view of the assembly shown in FIG. 6.
Figure 8:
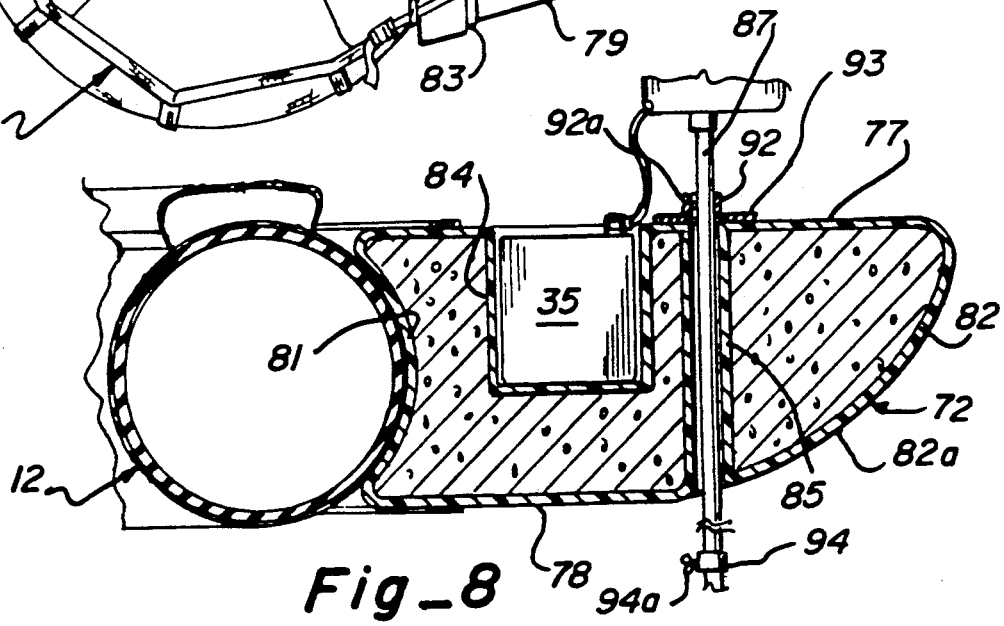
FIG. 8 is a sectional view taken along line 8—8 of FIG. 7.

The float device 12 is arranged so the user is seated at an angle of 90 degrees to the direction of travel of the floatable support body 72. This places the support body 72 to either the left or right side of the user 6. The support body 72 shown in FIGS. 6 and 7 is to the left side of the user. In both positions the user is able to manually steer the direction of movement of the assembly with one hand as described more fully hereafter. It is further understood that if desired the angle may be varied from the 90 degree orientation as, for example, 75 degrees since the float device can be rotated to any angle with respect to the support body 72 using the fastening harness 73 hereafter described.

In general, the floatable support body 72 includes a flat top wall 77, bottom wall 78, and a pair of outwardly diverging side walls 79. The side walls 79 taper inwardly from the inner end to the outer end which is in a direction away from the center of the float device. An inner end wall 81 is concave so as to be shaped and sized to conform to the rounded external surface of the inflated float device and an outer end wall 82 that has a downwardly and inwardly curved portion **82*a*. The inner end portion of body 72 is enlarged with respect to a straight side wall taper to form a step or notch 83 along opposite sides thereof. The outer end wall 82 is rounded as viewed from the top. As with the earlier described embodiment the support body 72 is made of an outer rigid skin filled with a floatable fill material and the body 72 has a density that is suitable for floating in water and supporting the user independently in case the float device deflates. The support body 72 further has a recessed wall portion 84 sized and shaped to receive and support an electric battery 35 and a tubular wall portion 85 forms a vertical hole in the body. The wall portion 84 is in close proximity to the inner end wall to keep the weight as close as possible to the center of the float device and wall portion 85 is between portion 84 and outer end wall 82 and as close as possible to wall portion 84** to keep the weight of the motor as close as possible to the center of the float device.

The power assembly shown includes a vertical shaft 87 which extends down through the vertical hole in the tubular wall portion 85 and is rotatable therein. A steering handle 88 is secured at the upper end of the vertical shaft 87 and the electric motor 89 driving a propeller 90 are mounted at the lower end of the shaft. Preferably, a weed guard and metal grid 91 is mounted over the propeller 90 to totally enclose the propeller for safety reasons. The electric battery 35 is mounted in the recessed wall portion 84 and is electrically connected to the electric motor 89 by suitable electric power lines. An upper collar 92 is releasably secured in an upper position on the vertical shaft 87 by a set screw **92*a* to position the propeller at a selected depth in the water. The upper collar 92 is shown as seated on a circular metal or plastic plate 93 on the top wall 77. A lower collar 94 with a set screw 94*a* on the shaft 87** prevents the support body from hitting the motor.

The fastening harness 73 shown includes an upper strap 96 and a lower strap 97 connected together by a plurality of circumferentially spaced vertical straps 98 sized and arranged so that the harness will fit around and firmly embrace the float device 12. Free ends of the straps 96 and 97 connect to a closed loop end strap 99 that is sized to slide over the narrower end portion of the tapered support body 72 and fit against notches 83.

The upper strap is made in two sections **96*a* and 96*b* adjacent the end strap 99. These sections are releasably connected by a two-piece buckle 101 that snapfits together to break or separate the upper strap into the two sections. The buckle 101 has two posts at opposite ends. One strap section 96*a* is sewn to one post and the other strap section 96*b* slides through a slot formed by the adjacent post to enable the length of the top strap to be adjusted to tighten the harness against the float device. Male and female parts of the buckle 101 between the posts snap-fit together and are readily released by applying pressure. The lower strap 97 similarly is made in two sections 97*a* and 97*b* connected by a buckle 102** to also provide a length adjustment and a separation as required.

Closed loop intermediate strap 103 extends around the end portions of the upper and lower straps and fastens thereto a distance inwardly from end strap 99. This intermediate strap 103 is made in two sections 103*a* and 103*b* and has a buckle 104 for length adjustment and selected separation and serves to draw the upper and lower straps firmly around the float device and provide for separation if required.

A safety strap 105 connects at one end to intermediate strap 103 and at the other end to end strap 99 and extends through the center hole in the float device to hold the fastening harness to the float device in case the float device deflates.

To assemble and fasten the float device 12 to the floatable support body 72 using the fastening harness 73, and end intermediate straps 99 and 103 are slipped over the narrower end portion of the float device. The safety strap 105 is then placed through the hole in the float device. The end of the strap 103 is extended between the float device and the support body through the safety strap and then its buckle is snapped. The fastening harness is placed around the float device horizontally, the associated buckles are closed, the free end sections of the upper and lower straps are pulled very tight to secure the float device and support body together in a firm tight-fitting relationship. To disassemble a reverse procedure is followed.

Figure 10:
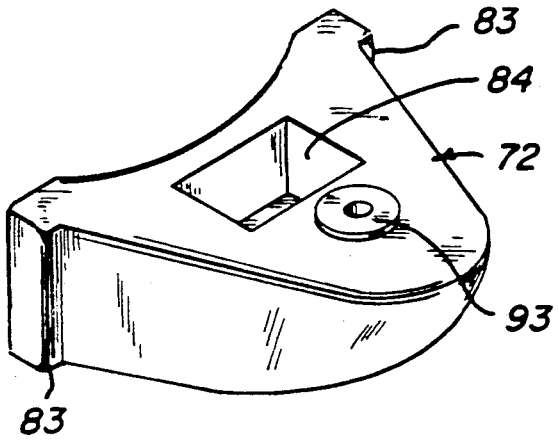
FIG. 10 is a perspective view of a floatable storage body embodying features of the present invention.
Figure 9:
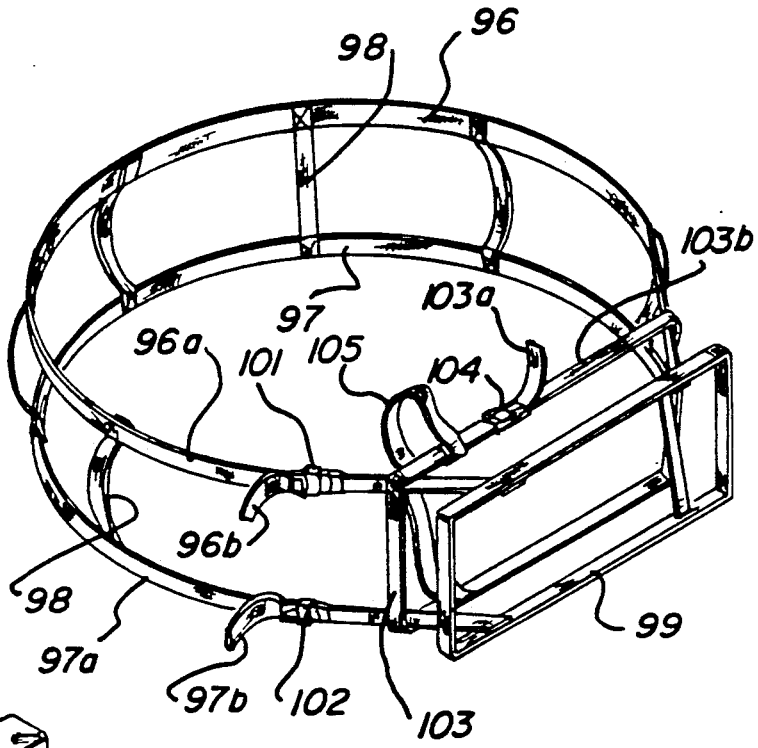
FIG. 9 is a perspective view of the fastening harness assembly shown in FIGS. 6 and 7.
Figure 12:
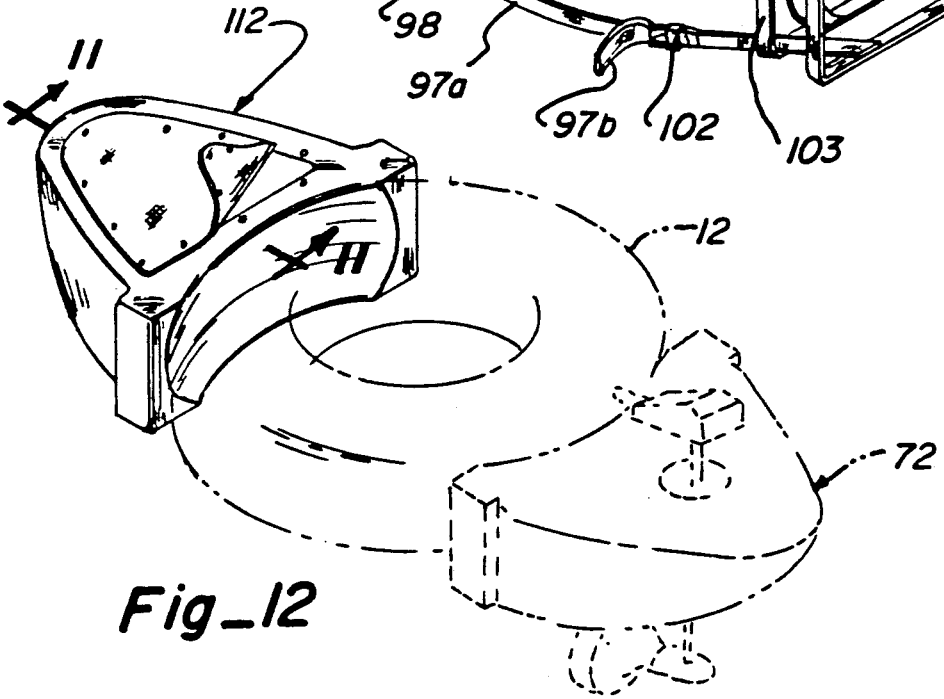
FIG. 12 is a perspective view of the floatable storage body and floatable support body at opposed positions on the harness assembly not shown.
Figure 11:
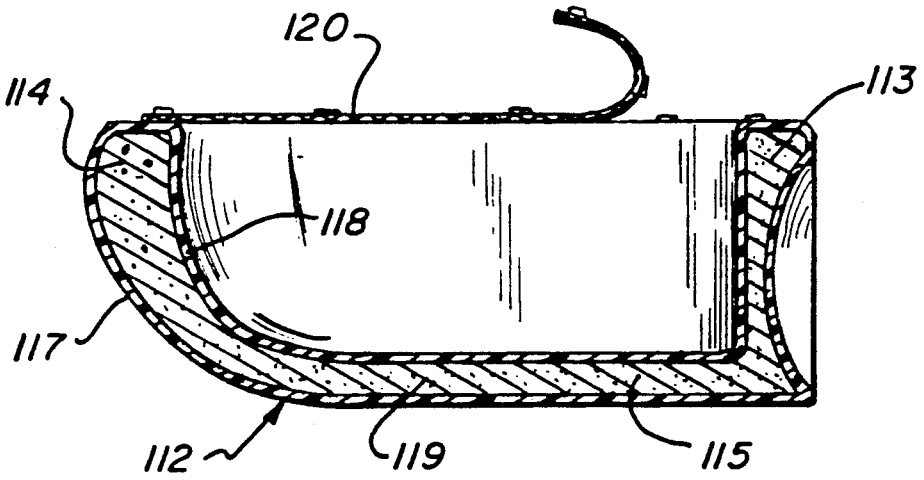
FIG. 11 is a sectional view taken along line 11—11 of FIG. 10.
Figure 13:
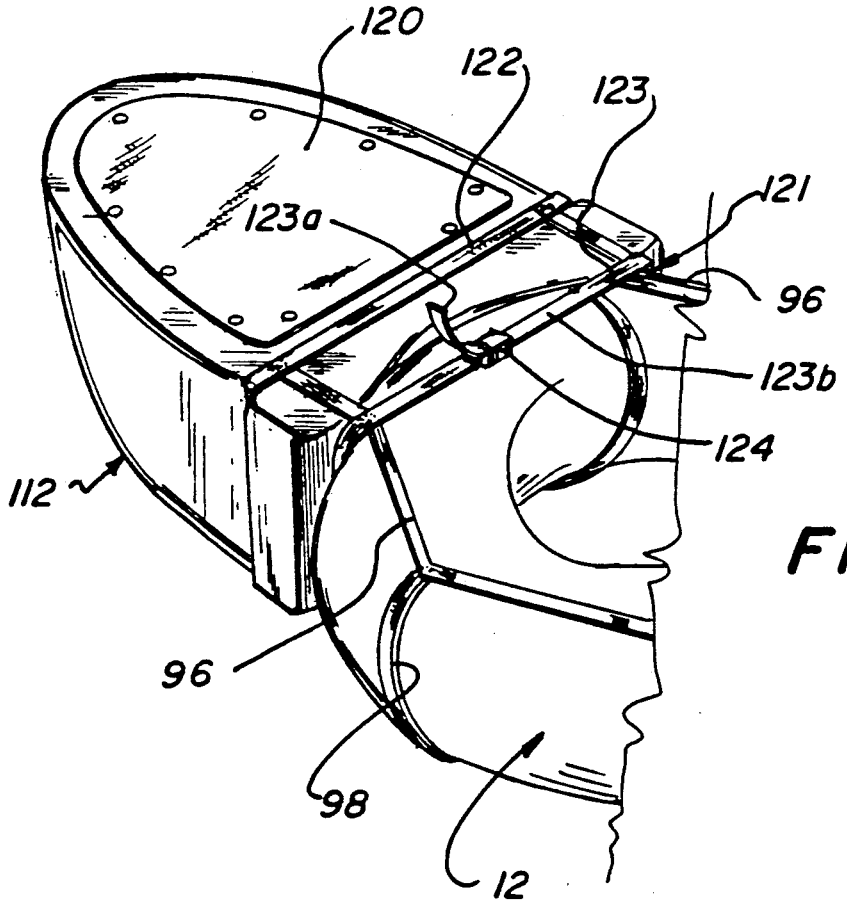
FIG. 13 is a perspective view of an auxiliary section of the harness assembly for securing the floatable storage body to the float device shown in FIG. 12.

Referring now to FIGS. 10–12 there is shown a floatable storage body 112 which, in general, has a shape corresponding with the shape of the floatable support body 72 above described and mounted in a position opposite that of the float device. This provides an assembly that is symmetrical about the center of the float device 12 for smooth, balanced travel through the water. Construction of this storage body again has the same external shape and is also made of the same general construction so that it is floatable. As best seen in FIG. 11, the storage body 112 is generally hollow and is formed with an inner wall portion 113, outer wall portion 114 and bottom wall portion 115 providing a central recessed area 116 with a top opening to define a storage compartment. The construction is an outer rigid skin 117, an inner rigid skin 118 and a fill layer 119 in between. The top opening of the compartment preferably is selectively covered with a vinyl cover 120. To hold the storage body to the float device, an auxiliary harness section 121 is attached opposite the closed loop end strap 99 and closed loop intermediate strap 103 above described. This auxiliary harness section includes a closed loop end strap 122 and a closed loop intermediate strap 123. The intermediate strap 123 is made in two sections 123*a* and 123*b* secured by a buckle 124. The assembly and disassembly procedure is generally the same as above described.

Although the present invention has been described with a certain degree of particularity, it is understood that the present disclosure has been made by way of example and that changes in details of structure may be made without departing from the spirit thereof.

What is claimed is:

1. A power-driven float assembly comprising, in combination:

an inflatable float device having rounded external shape with an inner cavity traversed by a seat defining a hole for legs for disposing a user in a selected orientation with the user floating thereon on a body of water, a floatable support body having a top wall, bottom wall and opposed sidewalls, said sidewalls being tapered inwardly from a wider inner end wall portion to a narrower outer end wall portion in a direction away from said float device, said inner end wall portion being shaped to conform to a rounded external surface of said float device, said support body being made of an outer rigid skin filled with a floatable fill material, said body having a density suitable for floating in water and supporting a user in water independently of said float device, fastening harness means secured at one end to said support body and having a side member that extends around the periphery of said float device and is pulled against said periphery by a fastener means for releasably attaching said support body to said float device, a power assembly carried by said support body including a vertical shaft extending through a vertical hole in said support body between said inner end wall portion and said outer end wall portion and rotatable therein, control means for use by the user for steering and controlling motor speed, an electric motor driving an impeller, said impeller being mounted for rotation at the lower end of said shaft, an electric battery mounted in a recessed wall portion in said top wall of said support body and electrically connected to said electric motor, said recessed wall portion being between said inner end wall portion and said shaft, whereby said power assembly is selectively actuated by the user to propel said float device in a body of water.

2. A power-driven float assembly as set forth in claim 1 wherein said fastening harness means includes an end loop band adapted to slide fit over said narrower outer end portion, said side member being in the form of a pair of side panels extending around the sides of said device and terminating in adjacent free end portions and said fastener means is at said free end portions to fasten said free end portions together.

3. A power-driven float assembly as set forth in claim 2 wherein said fastener means is in the form of a tie line that extends through holes in said free end portions, said side panels having a height dimension slightly less than the height of the float device.

4. A power-driven float assembly as set forth in claim 1 wherein said outer skin is made of polyethylene with said fill material being polyurethane.

5. A power-driven float assembly as set forth in claim 1 wherein said body has an outwardly and upwardly inclined curved bottom wall section to direct the flow of water away from the user's legs during use.

6. A power-driven float assembly as set forth in claim 1 wherein said support body has recessed wall portions shaped to receive and support a shaft mounting and rotation box.

7. A power-driven float assembly as set forth in claim 6 wherein said support body has a vertical tubular portion defining a vertical hole extending below said recessed wall portion and opening through the bottom thereof, said power assembly including a vertical shaft supporting a motor and impeller in the water, said vertical shaft being releasably held in a rotary sleeve in said box by a pin for ready assembly and disassembly of said shaft from said support body.

8. A power-driven float assembly as set forth in claim 1 wherein said fastening harness means includes a closed loop end strap sized to slide over said narrower outer end wall portion with said side member being in the form of an upper strap, a lower strap and said straps being connected together by a plurality of circumferentially spaced vertical straps.

9. A power-driven float assembly as set forth in claim 8 including a closed loop intermediate strap fastened to said upper and lower straps a distance inwardly of said end strap to draw said upper and lower straps firmly around said float device.

10. A power-driven float assembly as set forth in claim 9 wherein said intermediate strap is made in two sections secured by a two-piece, snap-fit buckle to enable the varying of the length of said intermediate strap to tighten said upper, lower and intermediate straps against said float device and to enable the separation of said intermediate strap into two parts to apply and remove said straps from said float device.

11. A power-driven float assembly as set forth in claim 8 wherein each of said upper and lower straps are made in two sections secured by a two-piece, snap-fit buckle to enable the varying of the length of each of said upper and lower straps to tighten said upper and lower straps against said float device and to enable the separation of the associated strap into two parts to apply and remove said straps from said float device.

12. A power-driven float assembly as set forth in claim 9 including a safety strap connected between said intermediate and end straps and extending through said hole in said float device to hold said fastening means to said float device when said float device deflates.

13. A power-driven float assembly as set forth in claim 1 wherein said support body extends to the rear of said float device with respect to the orientation of the user in said float device.

14. A power-driven float assembly as set forth in claim 1 wherein said support body extends to the side of said float device with respect to the orientation of the user in said float device.

15. A power-driven float assembly as set forth in claim 1 including an upper collar releasably secured at an upper position to said shaft by a set screw to adjust the depth of said impeller in the water.

16. A power-driven float assembly as set forth in claim 1 including a lower collar with a set screw between said support body and said impeller to prevent said support body from hitting said impeller.

17. A power-driven float assembly as set forth in claim 1 further including a weed guard and grid surrounding said impeller to completely enclose said impeller for safety purposes.

18. A power-driven float assembly as set forth in claim 1 further including a floatable storage body releasably fastened to said float device opposite said support body.

19. A power-driven float assembly as set forth in claim 18 wherein said storage body is of a corresponding size and shape with said support body.

20. A power-driven float assembly as set forth in claim 19 wherein said storage body is generally hollow having a central recessed area with a top opening defining a storage compartment, a cover for said top opening, said storage body having a double-walled, rigid skin filled with a floatable fill material.

21. A power-driven float assembly as set forth in claim 19 wherein said fastening harness means includes an auxiliary harness section, a closed loop end strap and a closed loop intermediate strap adapted to slide over a narrower end portion of said storage body and a top strap and a bottom strap extending around said float device to releasably secure said storage body to said float device.

22. A power-driven float assembly comprising, in combination:

an inflatable generally torus-shaped float device having rounded outer peripheral surfaces with an inner cavity traversed by a seat adapted to receive a user for floating thereon on a body of water, a rearwardly tapered floatable support body having a flat top wall, a flat bottom wall and inclined side walls tapered inwardly from a narrower outer end wall portion toward a wider rear inner end wall portion, said support body being made of an outer skin of polyethylene and filled with a polyurethane fill material, said body having a density suitable for floating in water and supporting a user in water independently of said float device, said support body having a recessed wall portion shaped to receive and support an electric battery, said support body having recessed wall portions shaped to receive and support a shaft mounting box, said support body having a vertical hole through which a vertical shaft extends, an electric motor driving an impeller mounted for rotation on the lower end of said shaft, said shaft extending up through said box and releasably fastened at the upper end to said box, said support body having an arcuate recess in said rear inner end wall portion shaped to conform to the rounded external shape of said float device, and a fastening harness including a closed loop end band portion adapted to fit over the tapered external surface of said body, a pair of side panels connected at the front ends to said band and having spaced holes in the ends through which the line is passed to fasten said support body to said float device.

23. A power-driven float assembly comprising, in combination:

an inflatable, generally torus-shaped float device having rounded outer peripheral surfaces with an inner cavity traversed by a seat strap to define a hole for legs on opposite sides of the seat strap for disposing a user in a selected orientation with the user floating thereon on a body of water, a floatable support body having top, bottom and opposed sidewalls, said side walls being tapered inwardly from a wider inner end wall portion to a narrower outer end wall portion away from said float device, said inner end wall portion being shaped to conform to a rounded external surface of said float device, said support body being made of an outer rigid skin filled with a floatable fill material, said filled body having a density suitable for floating in water and supporting a user independently of said float device, fastening harness means secured at one end to said support body and having an upper strap and lower strap connected together by a plurality of circumferentially spaced vertical straps that extends around the periphery of said float device and a closed loop end strap that connects to said upper and lower straps and slide fits over said support body with said upper and lower straps being adjustable in length to draw said float device against said support body for releasably attaching said support body to a side of said float device, a power assembly carried by said support body including a vertical shaft extending through a vertical hole in said support body and rotatable therein, a steering handle secured at an upper end of said shaft and extending toward the user for use by the user for steering and controlling motor speed, an electric motor driving an impeller mounted for rotation at the lower end of said shaft, an electric battery mounted in a recess end wall portion in the top wall of said support body and electrically connected to said electric motor, whereby said power assembly is selectively actuated to propel said float device in a body of water.

* * * * *